US009893468B2

(12) United States Patent
Zhao

(10) Patent No.: US 9,893,468 B2
(45) Date of Patent: Feb. 13, 2018

(54) ELECTRICAL CONNECTOR ASSEMBLY HAVING IMPROVED SHIELDING SHELL

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/605,907

(22) Filed: May 25, 2017

(65) Prior Publication Data

US 2017/0346232 A1 Nov. 30, 2017

(30) Foreign Application Priority Data

May 25, 2016 (CN) ..... 2016 1 0352444

(51) Int. Cl.

| | |
|---|---|
| ***H01R 13/64*** | (2006.01) |
| ***H01R 13/629*** | (2006.01) |
| ***H01R 12/70*** | (2011.01) |
| *H01R 24/60* | (2011.01) |
| *H01R 13/6586* | (2011.01) |
| *H01R 13/6582* | (2011.01) |
| *H01R 107/00* | (2006.01) |
| *H01R 4/24* | (2006.01) |

(52) U.S. Cl.

CPC ..... *H01R 13/64* (2013.01); *H01R 12/7005* (2013.01); *H01R 13/629* (2013.01); *H01R 4/2404* (2013.01); *H01R 13/6582* (2013.01); *H01R 13/6586* (2013.01); *H01R 24/60* (2013.01); *H01R 2107/00* (2013.01)

(58) Field of Classification Search

None

See application file for complete search history.

(56) References Cited

U.S. PATENT DOCUMENTS 5,035,652 A * 7/1991 Shibano ..... H01R 13/506 439/108

5,967,846 A * 10/1999 Davis ..... H01R 13/65802 439/567

(Continued)

*Primary Examiner* — James Harvey

(74) *Attorney, Agent, or Firm* — Wei Te Chung; Ming Chieh Chang

(57) ABSTRACT

A receptacle connector for mating with a plug connector, the receptacle connector includes: a terminal module comprising an insulative housing, two rows of terminals, and a metallic shielding plate, the insulative housing having a base portion and a tongue portion, the tongue portion defining two opposite surfaces, the two rows of terminals being reversely-symmetrically arranged at the two surfaces of the tongue portion, the metallic shielding plate located between the two rows of terminals; and a shielding shell retained to the insulative housing and forming a mating cavity to receive the tongue portion, wherein the shielding shell defines a mating protrusion on one of the plurality of side walls, the mating protrusion extending outwardly to be precluded from reversely mating with the plug connector which has a contour compliant with said mating cavity and an identification protrusion accommodated in the mating protrusion.

9 Claims, 14 Drawing Sheets

(56) References Cited

U.S. PATENT DOCUMENTS

| | | | | |
|---|---|---|---|---|
| 6,007,381 | A * | 12/1999 | Ando | H01R 12/7064 439/607.01 |
| 6,280,251 | B1 * | 8/2001 | Nishio | H01R 13/64 439/607.36 |
| 9,490,579 | B2 * | 11/2016 | Little | H01R 13/642 |
| 2002/0101041 | A1 * | 8/2002 | Kameyama | H01R 13/521 277/628 |
| 2009/0088024 | A1 * | 4/2009 | Ling | H01R 13/64 439/607.01 |
| 2014/0024257 | A1 * | 1/2014 | Castillo | H01R 13/6585 439/607.05 |
| 2014/0065869 | A1 * | 3/2014 | Xu | H01R 13/629 439/345 |
| 2014/0113481 | A1 * | 4/2014 | Little | H01R 13/64 439/374 |
| 2014/0335729 | A1 * | 11/2014 | Little | H01R 24/60 439/607.53 |
| 2015/0207273 | A1 * | 7/2015 | Zhao | H01R 13/6594 439/78 |

* cited by examiner

ELECTRICAL CONNECTOR ASSEMBLY HAVING IMPROVED SHIELDING SHELL

BACKGROUND OF THE INVENTION

1. Field of the Invention

The present invention relates to a receptacle connector adapted for being normally mated with a plug connector, and more particularly to an electrical connector assembly having shielding shells with cooperating protrusions.

2. Description of Related Art

U.S. Pat. No. 9,490,579, issued on Mar. 9, 2016, discloses a receptacle connector assembly comprising a metallic shield enclosing an insulative housing to define a capsular mating cavity. The metallic shield defines an identification protrusion extending inwardly into the mating cavity so as to be precluded from mating with a standard plug connector, which has a contour compliant with said capsular mating cavity, but being adapted to be mated with a customized plug connector which also has a contour compliant with said capsular mating cavity and further with a corresponding slot to receive said identification protrusion. The receptacle connector assembly only allows the customized plug connector to be mated with it to transmit the customized signals. The compatibility between the receptacle connector assembly and the standard plug connector is poor.

An electrical connector assembly having a unique shielding shell is desired.

SUMMARY OF THE INVENTION

A receptacle connector, for mating with a plug connector, comprises: a terminal module comprising an insulative housing, two rows of terminals, and a metallic shielding plate, the insulative housing having a base portion and a tongue portion extending forwardly from the base portion in a front-to-rear direction, the tongue portion defining two opposite surfaces, the two rows of terminals being reversely-symmetrically arranged at the two surfaces of the tongue portion, the metallic shielding plate located between the two rows of terminals; and a shielding shell retained to the insulative housing and forming a mating cavity to receive the tongue portion, the shielding shell having a plurality of side walls; wherein the shielding shell defines a mating protrusion on one of the plurality of side walls, the mating protrusion extending outwardly to be precluded from reversely mating with the plug connector which has a contour compliant with said mating cavity and an identification protrusion accommodated in the mating protrusion.

Other novel features of the invention will become more apparent from the following detailed description when taken in conjunction with the accompanying drawings.

DETAILED DESCRIPTION OF THE PREFERRED EMBODIMENT

Figure 1:
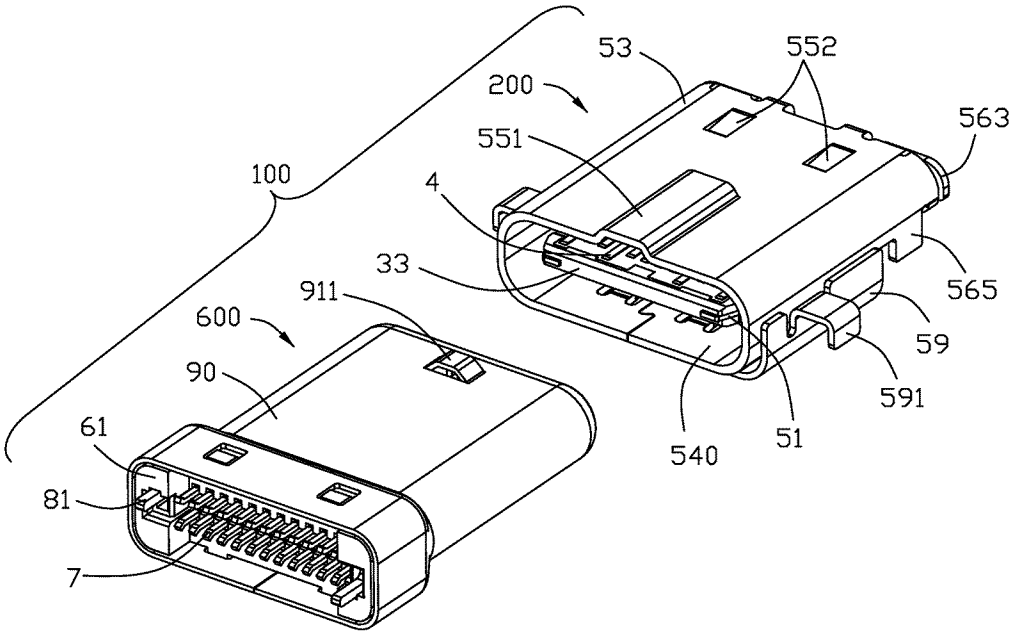
FIG. 1 is an assembled perspective view of the receptacle connector and the plug connector when not in contact with each other of the electrical connector assembly of a preferred embodiment of the instant invention.
Figure 2:
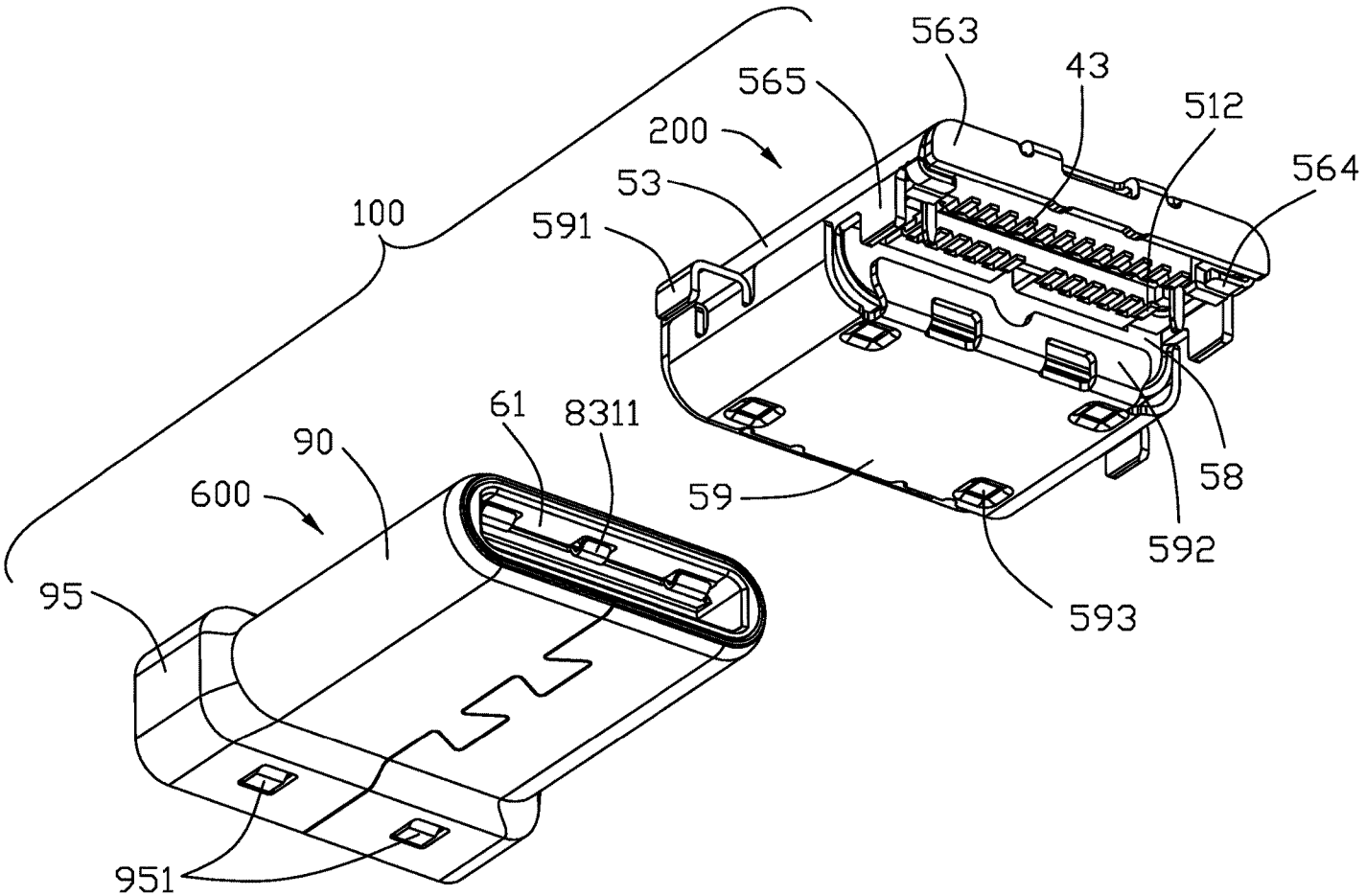
FIG. 2 is an assembled perspective view of FIG. 1 seen from another direction.
Figure 3:
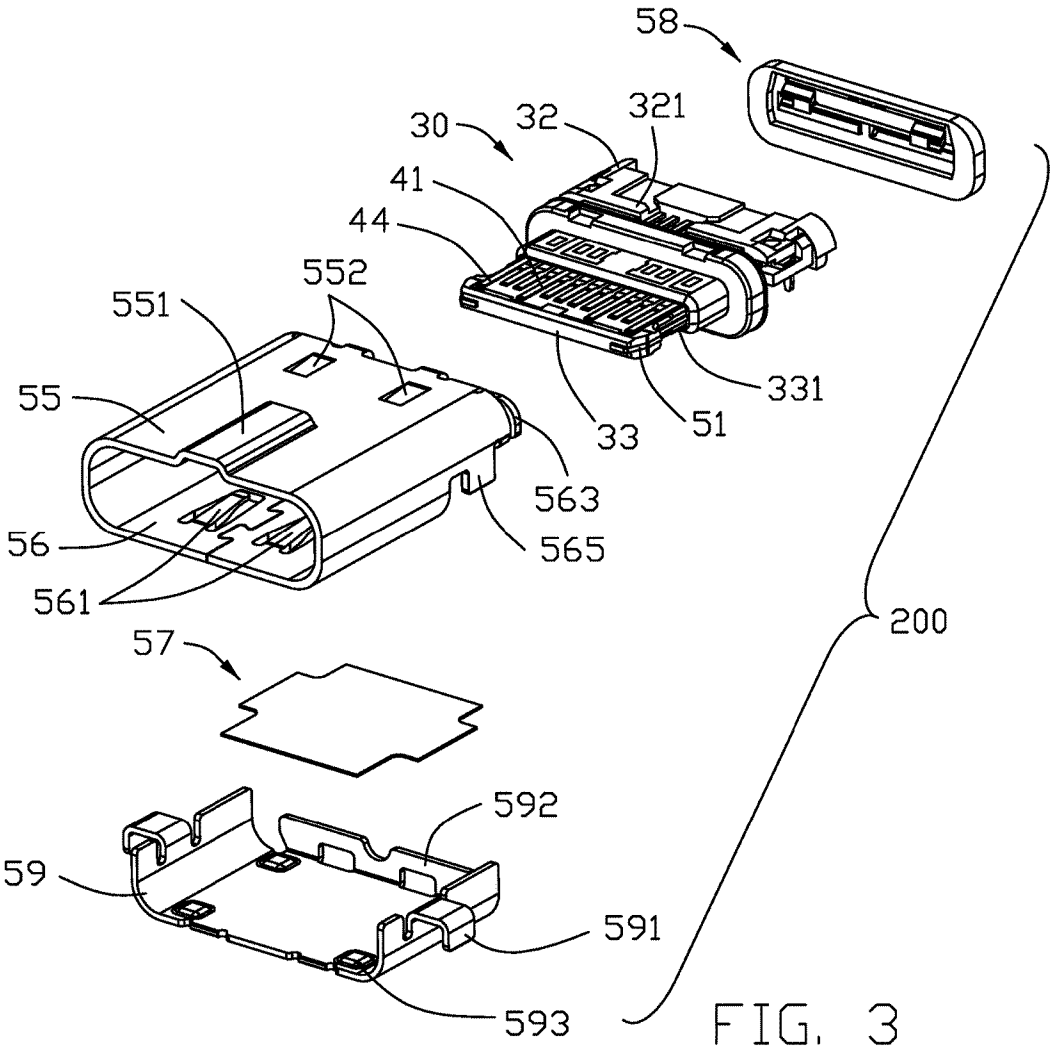
FIG. 3 is a partially exploded perspective view of the receptacle connector of the electrical connector assembly of a preferred embodiment of the instant invention.
Figure 4:
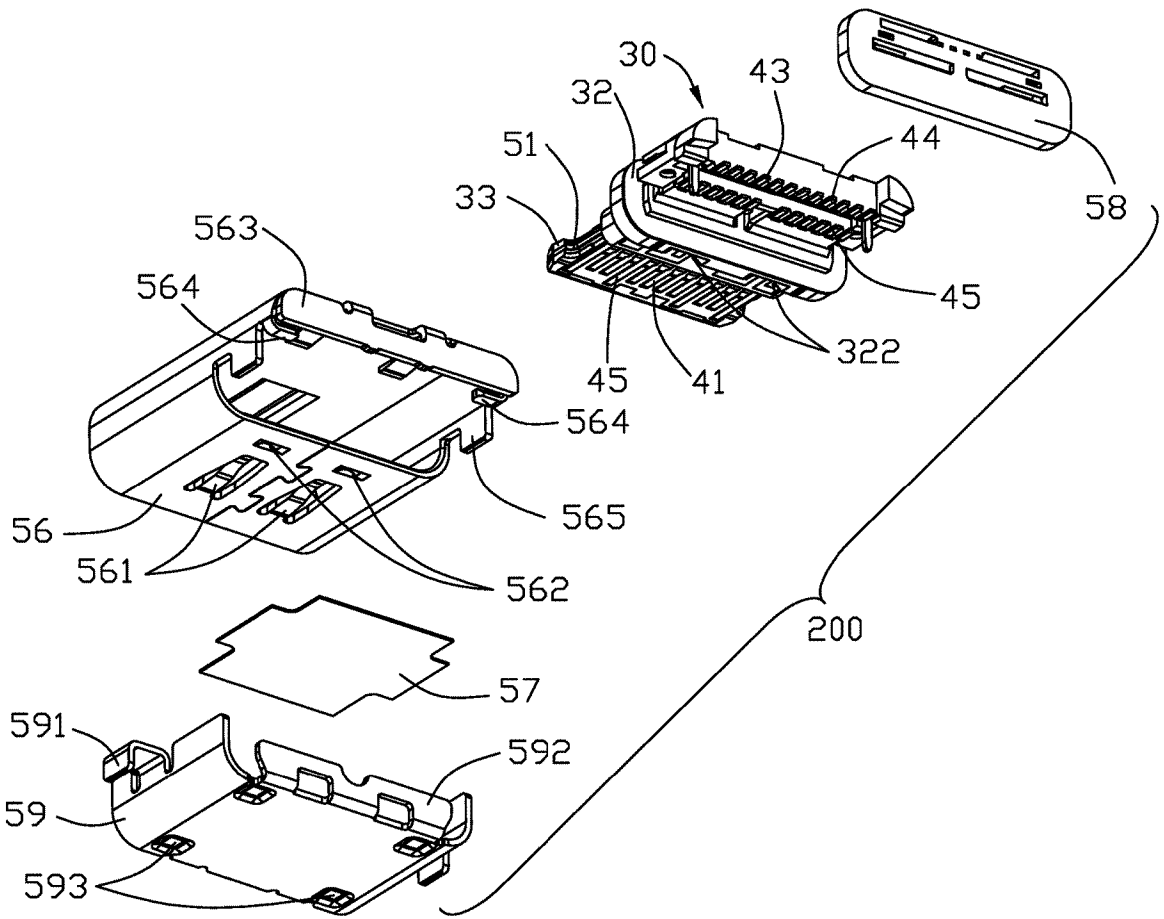
FIG. 4 is a partially exploded perspective view of FIG. 3 seen from another direction.
Figure 5:
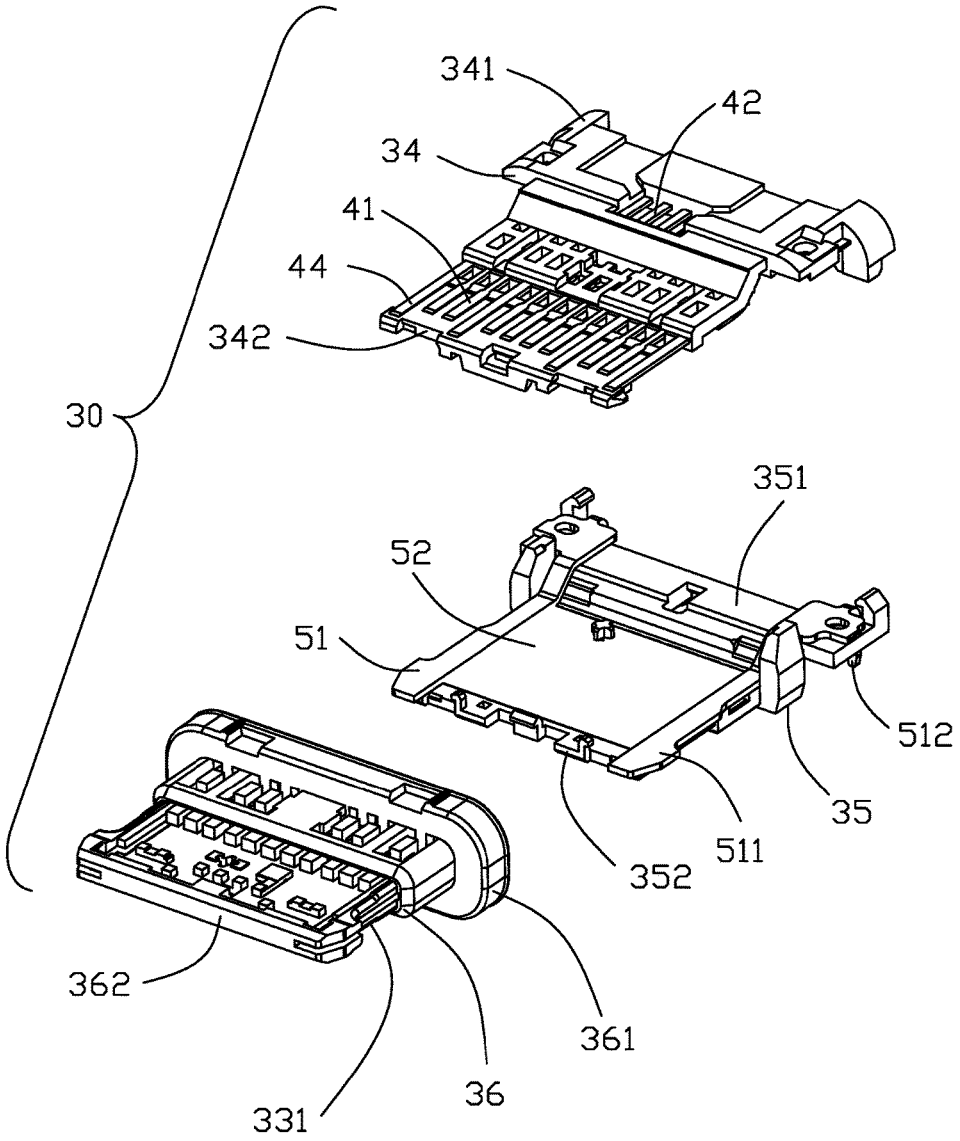
FIG. 5 is a partially exploded perspective view of the terminal module of FIG. 4.
Figure 6:
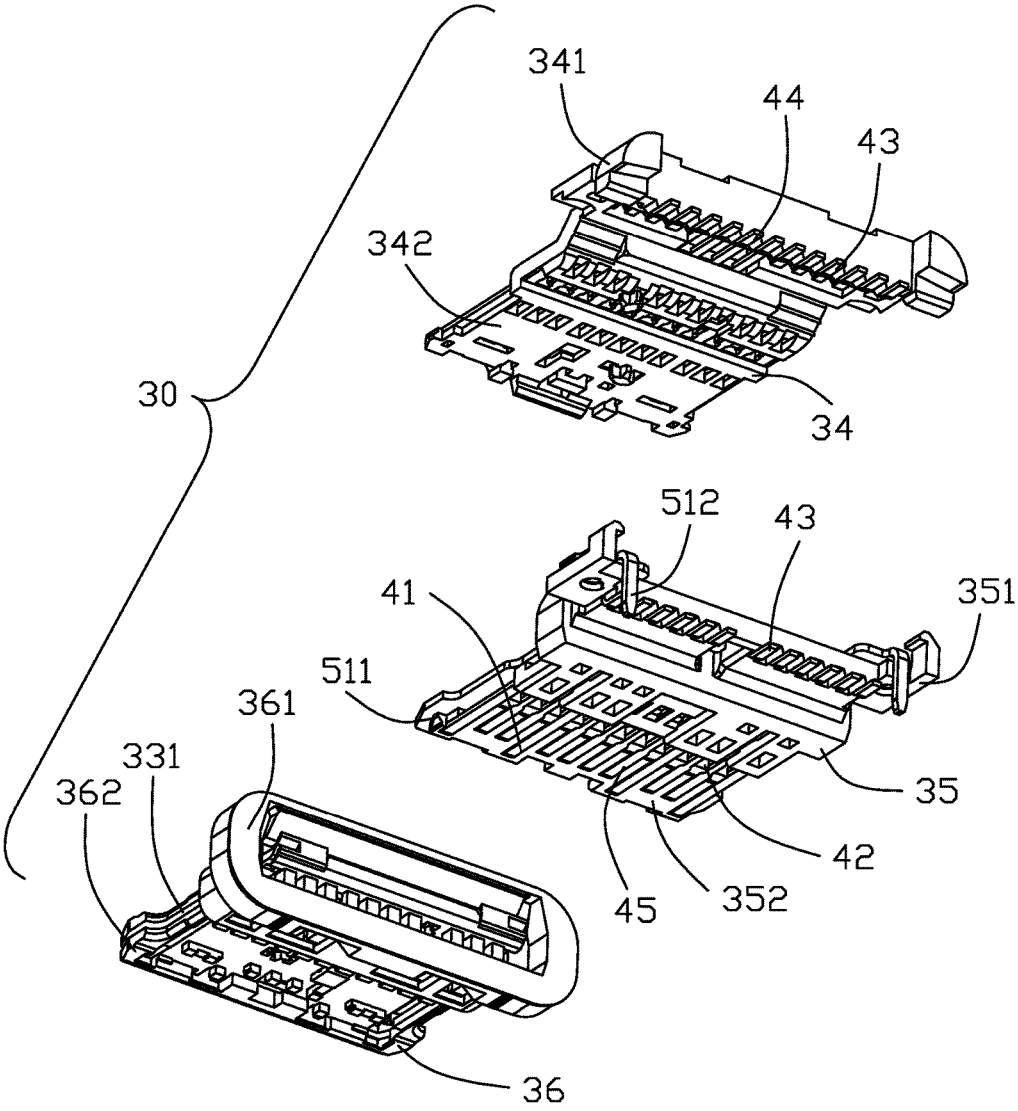
FIG. 6 is a partially exploded perspective view of FIG. 5 seen from another direction.
Figure 7:
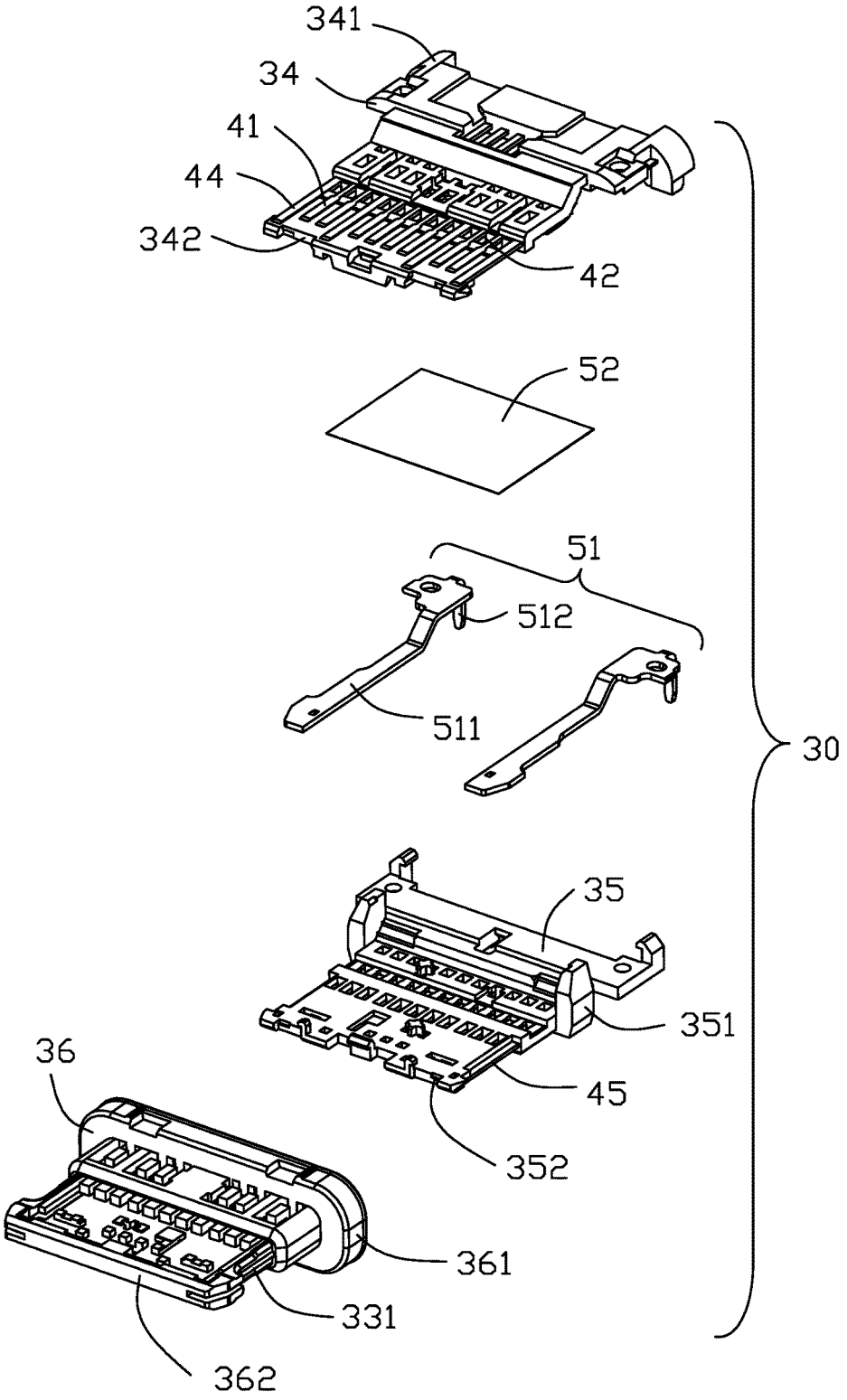
FIG. 7 is a partially exploded perspective view of further exploded of the terminal module of FIG. 5.
Figure 8:
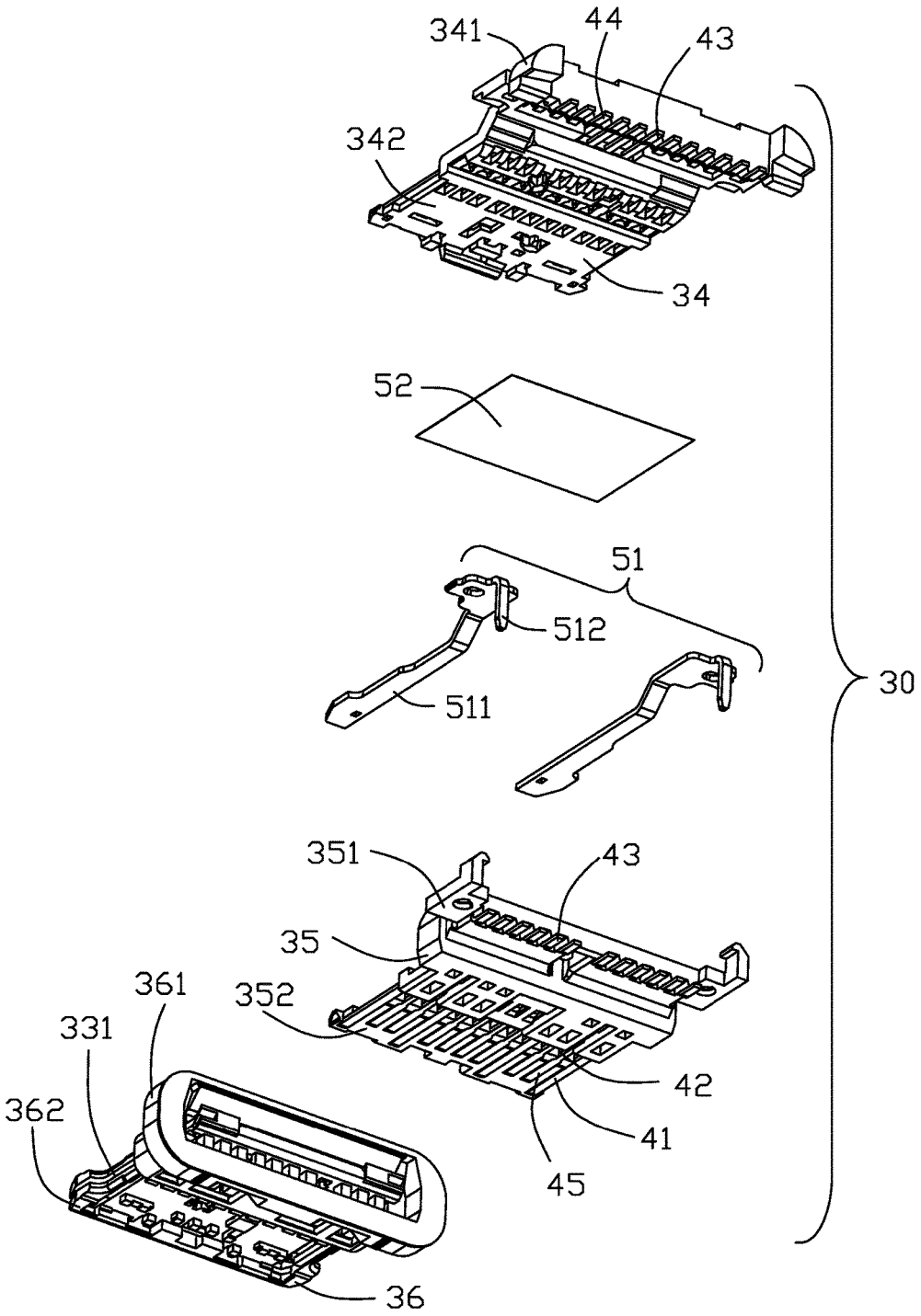
FIG. 8 is a partially exploded perspective view of FIG. 7 seen from another direction.
Figure 9:
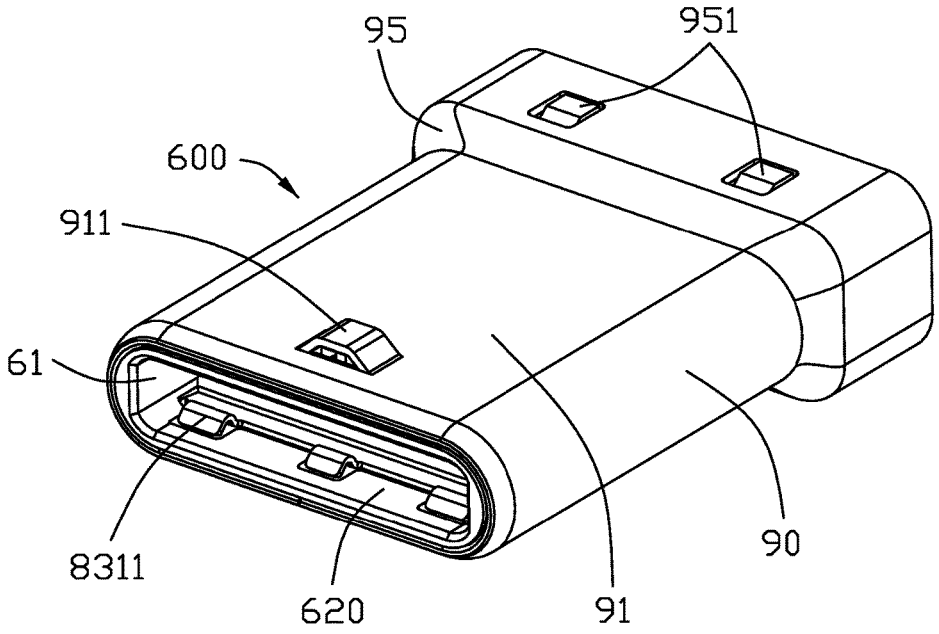
FIG. 9 is an assembled perspective view of the plug connector of the electrical connector assembly of a preferred embodiment of the instant invention.
Figure 10:
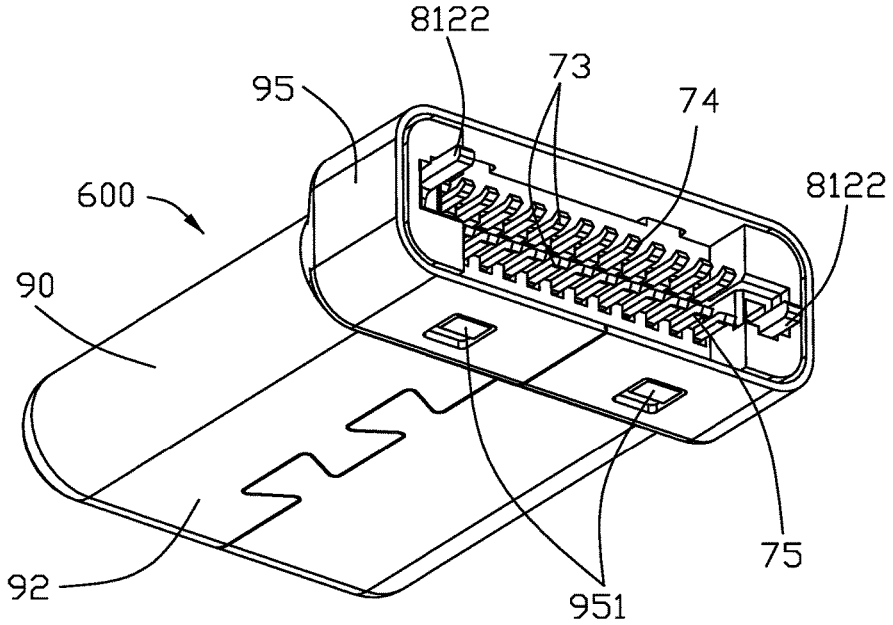
FIG. 10 is an assembled perspective view of FIG. 9 seen from another direction.
Figure 11:
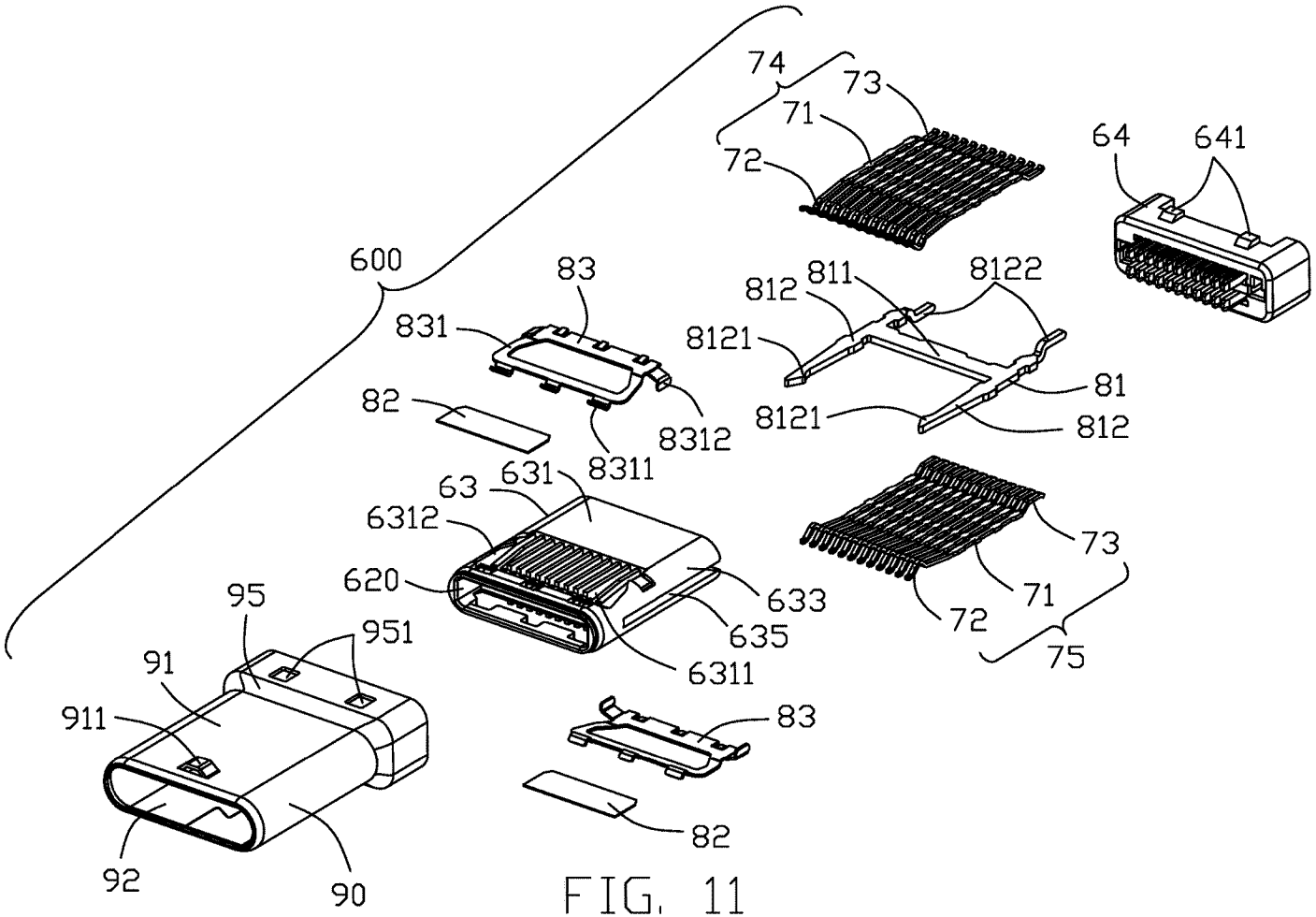
FIG. 11 is a perspective view of the plug connector of the electrical connector assembly of a preferred embodiment of the instant invention.
Figure 12:
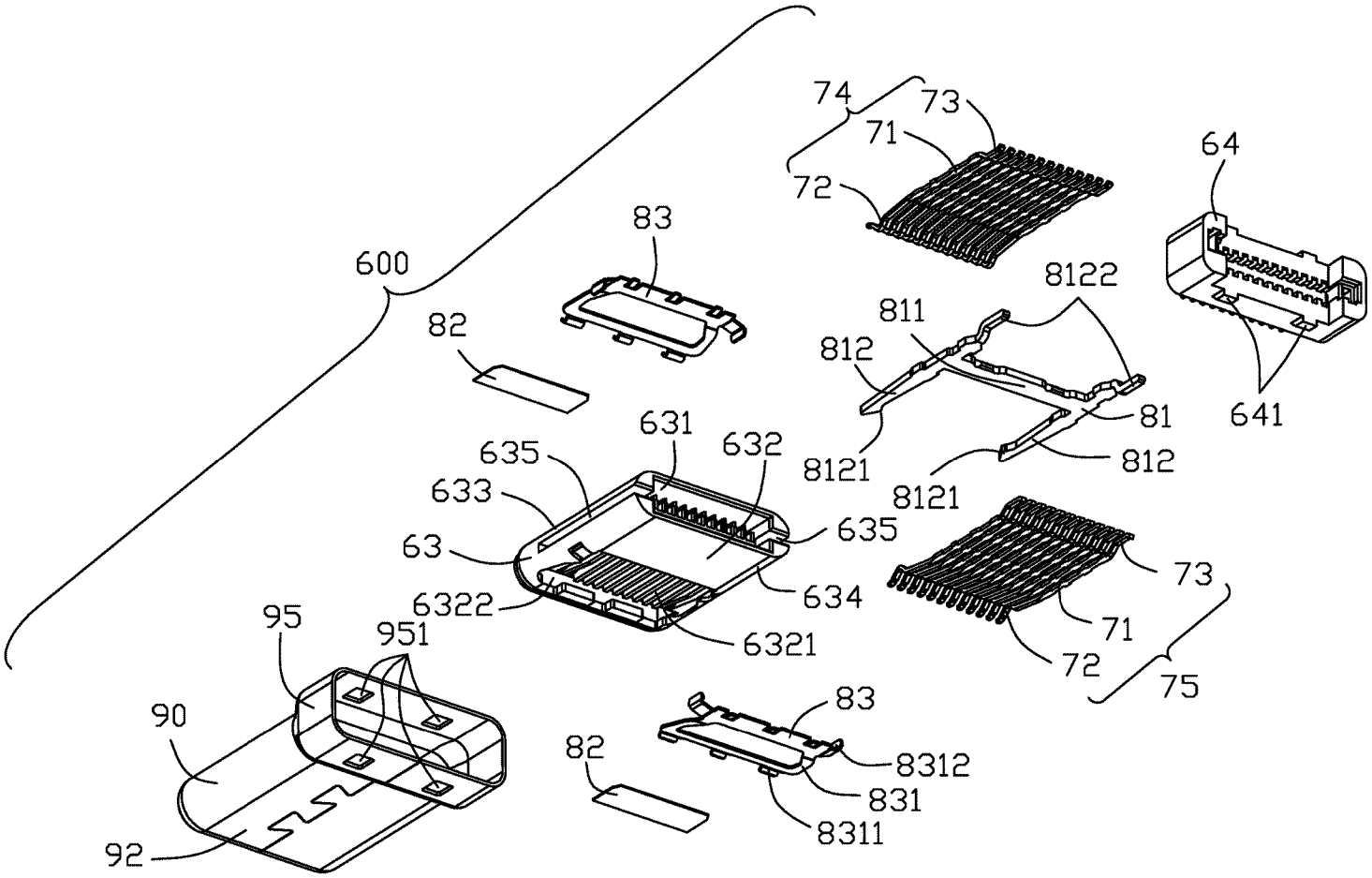
FIG. 12 is a perspective view of FIG. 11 seen from another direction.
Figure 13:
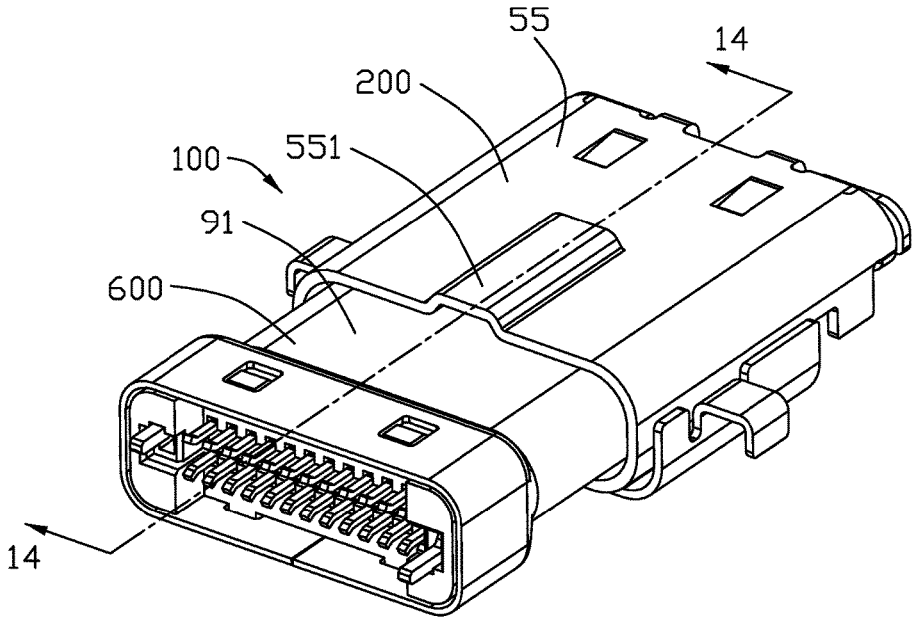
FIG. 13 is an assembled perspective view of the receptacle connector mated with the plug connector of a preferred embodiment of the instant invention.
Figure 14:
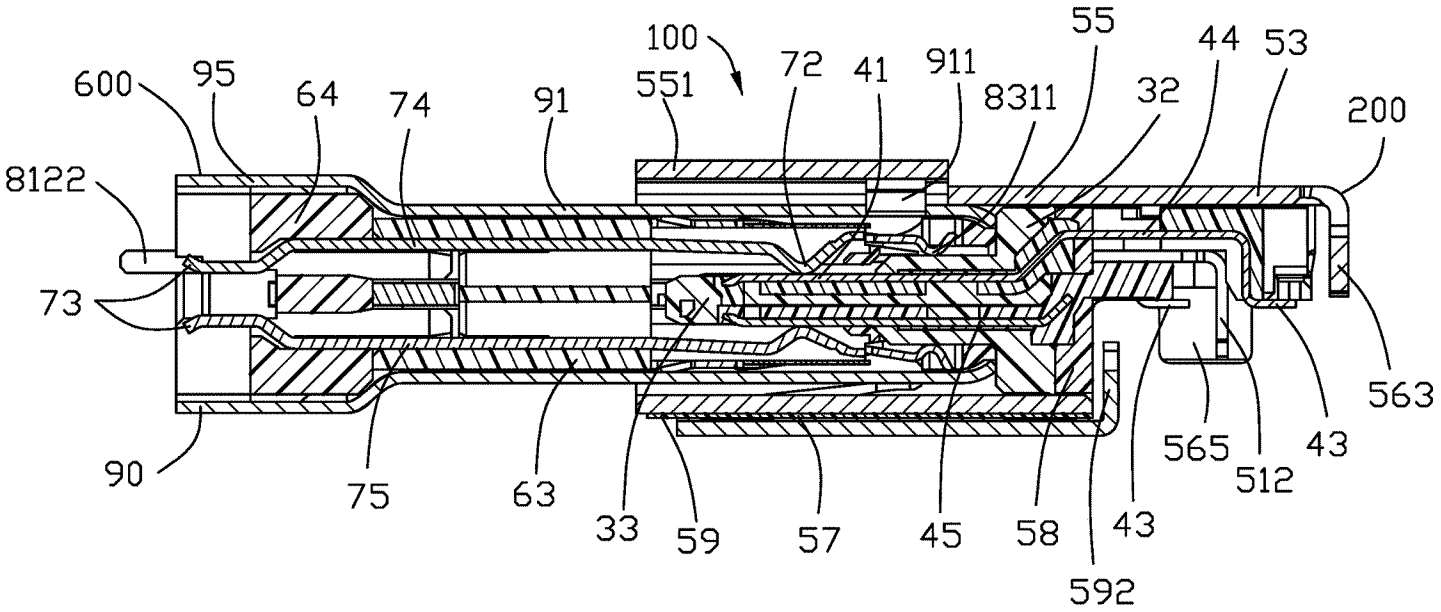
FIG. 14 is a cross-sectional view of the electrical connector assembly of a preferred embodiment of the instant invention taken along line 14-14 of FIG. 13.

Reference will now be made in detail to the preferred embodiment of the present invention shown in FIGS. 1 to 14.

The receptacle connector 200 and the plug connector 600 of the electrical connector assembly 100 have an insertion opening, respectively, to mate each other. The receptacle connector 200 and the plug connector 600 have a front-to-rear direction, a transverse direction perpendicular to the front-to-rear direction, and a vertical direction perpendicular to both the front-to-rear direction and the transverse direction, respectively. Referring to FIGS. 1-8 and 13-14, the receptacle connector 200 defines the insertion opening at the front end thereof. Referring to FIGS. 9-12, the plug connector 600 defines the insertion opening at the front end thereof.

Referring to FIGS. 1-14, an electrical connector assembly 100 includes a receptacle connector 200, and a plug connector 600 mating with the receptacle connector 200. The receptacle connector 200 includes a terminal module 30, a shielding shell 53, a waterproof layer 57, a sealer 58, and a metallic bracket 59. The plug connector 600 includes an insulative body 61, two rows of plug terminals 7, a latch 81, a pair of grounding members 83, a pair of second insulative plates 82, and a metal shell 90.

Referring to FIGS. 1-8 and 13-14, the terminal module 30 of the receptacle connector 200 includes an insulative housing 31, two rows of terminals 4, a pair of metallic shielding plates 51, and a first insulative plate 52. The insulative housing 31 has a base portion 32 and a tongue portion 33 extending forwardly from the base portion 32 in the front-to-rear direction. The base portion 32 has a resisting wall 321 on the upper surface thereof, and a pair of resisting grooves 322 on the front surface thereof. The tongue portion 33 has a pair of concave grooves 331 on both sides in the transverse direction. The insulative housing 31 further has a first insulator 34, a second insulator 35, and a third insulator 36. The first insulator 34 has a first base portion 341 and a first tongue portion 342 extending forwardly from the first base portion 341. The second insulator 35 has a second base portion 351 and a second tongue portion 352 extending forwardly from the second base portion 351. The third insulator 36 has a third base portion 361 and a third tongue portion 362 extending forwardly from the third base portion 361. The first base portion 341, the second base portion 351, and the third base portion 361 collectively form the base portion 32. The first tongue portion 342, the second tongue portion 352, and the third tongue portion 362 collectively form the tongue portion 33.

The two rows of terminals 4 include a plurality of upper terminals 44 and a plurality of lower terminals 45. Each of the upper terminals 44 and lower terminals 45 includes a contacting section 41, a retention section 42, and a soldering section 43.

The pair of metallic shielding plates 51 are arranged symmetrically to each other. Each metallic shielding plate 51 includes a main arm 511, and a soldering arm 512 extending downwardly from the rear end of the main arm 511.

The shielding shell 53 is made of metal material, and is stamped stainless or metal injection molding. The shielding shell 53 includes an upper side wall 55, a bottom side wall 56, a left side wall, and a right side wall. The shielding shell 53 retains with the insulative housing 31. The four side walls of the shielding shell 53 are formed with a mating cavity 540 to receive the tongue portion 33. In the preferred embodiment, the preferred upper side wall 55 of the shielding shell 53 further includes a mating protrusion extending outwardly from the upper side wall 55. The mating protrusion allows the plug connector 600 which has an identification protrusion to be mated normally with the receptacle connector 200. The mating protrusion in this embodiment is a first convex portion 551 on the upper side wall 55 and formed by outward stamped the upper side wall 55 from the mating cavity 540. The first convex portion 551 extends rearward from a front end edge of the shielding shell 53. The front end edge of the first convex portion 551 is flush with the front end edge of the shielding shell 53. The shielding shell 53 further includes a pair of first elastic arms 552 on the upper side wall 55, a pair of second elastic arms 561 and a pair of front stopping portions 562 on the bottom side wall 56, a first rear stopping portion 563 at the tail of the shielding shell 53, and a pair of clamping portions 564 and a pair of securing legs 565 on both sides in the transverse direction of the tail of the shielding shell 53. The pair of second elastic arms 561 and the pair of front stopping portions 562 are formed by tearing and extending into the mating cavity 540, respectively.

The metallic bracket 59 includes a plurality of tubers 593, a pair of hook portions 591 on both sides in the transverse direction thereof, and a second rear stopping portion 592 at the tail thereof.

Referring to from the FIGS. 1-8 and 13-14, the upper terminals 44 and lower terminals 45 are diagonally symmetrically arranged with each other. The upper terminals 44 are integrated with the first insulator 34 to from an upper module. The retention section 42 of each upper terminal 44 is retained in the first base portion 341 and the first tongue portion 342. The contacting section 41 of each upper terminal 44 is exposed to an upper surface of the first tongue portion 342. The soldering section 43 of each upper terminal 44 is extending outwardly from a rear surface of the first base portion 341. The lower terminals 45 are integrated with the second insulator 35 to form a lower module. The retention section 42 of each lower terminal 45 is retained in the second base portion 351 and the second tongue portion 352. The contacting section 41 of each lower terminal 45 is exposed to a lower surface of the second tongue portion 352. The soldering section 43 of each lower terminal 45 is extending outwardly from a rear surface of the second base portion 351. The soldering sections 43 of the upper terminals 44 and the soldering sections 43 of the lower terminals 45 are arranged in two rows in the front-to-rear direction.

The first insulative plate 52 is made of insulating material. The upper module retained with the upper terminals 44, the pair of metallic shielding plates 51, and the first insulative plate 52, and the lower module retained with the lower terminals 45 are assembled together in the vertical direction. The pair of metallic shielding plates 51 are symmetrically provided on both sides between the first insulator 34 and the second insulator 35. The first insulative plate 52 is located at an intermediate position between the first insulator 34 and the second insulator 35 and is positioned transversely between the pair of metallic shielding plates 51. The first insulative plate 52 and the pair of metallic shielding plates 51 collectively separate the upper terminals 44 and the lower terminals 45.

The third insulator 36 is integrated with the upper module and the lower module to form the terminal module 30. The outside of the main arm 511 of each metallic shielding plate 51 is exposed in each concave groove 331 of the tongue portion 33, respectively. The soldering arms 512 of the pair of metallic shielding plates 51 are exposed to the rear end of the base portion 32.

The shielding shell 53 is assembled to the outside of the insulative housing 31. The front stopping portions 562 resist rearward against the resisting grooves 322 of the base portion 32, respectively. The first elastic arms 552 resist forwardly against the rear end of the resisting wall 321. The first rear stopping portion 563 resists forwardly against the rear end of the shielding shell 53. The pair of clamping portions 564 clamps the both sides of the tail of the base portion 32. The pair of front stopping portions 562, the pair of first elastic arms 552, the first rear stopping portion 563, and the pair of clamping portions 564 collectively prevent the terminal module 30 from moving forwardly or backwardly, and fix the terminal module 30 and the shielding shell 53 together firmly.

The waterproof layer 57 is installed on the outer surface of the bottom side wall 56. The waterproof layer 57 is used for covering the openings formed by the pair of second elastic arms 561 and the pair of front stopping portions 562.

Each tuber 593 of the metallic bracket 59 is directly used for retaining with and/or soldering to the outer surface of the bottom side wall 56 of the shielding shell 53. Both sides of the metallic bracket 59 are surrounding the left side wall and a right side wall of the shielding shell 53. The second rear stopping portion 592 resists forwardly against the rear edge of the shielding shell 53.

The sealer 58 is made of insulating material. The sealer 58 seals up the gap between the base portion 32 and the rear end of the shielding shell 53.

The pair of hook portions 591 of the metallic bracket 59 and the pair of securing legs 565 collectively are mounted on an electronic device (not shown) to suspend the receptacle connector 200 in a mounting slot of the electronic device.

Referring to FIGS. 9-12, the plug connector 600 includes an insulative body 61 has a plug space 620. The insulative body 61 includes a first plug insulator 63 and a second plug insulator 64 mounts on the rear end of the first plug insulator 63. The first plug insulator 63 includes an upper wall 631, a bottom wall 632, a left wall 633, and a right wall 634 that surround the formation of the plug space 620. The upper wall 631 includes a plurality of first terminal grooves 6311 and a first mounting groove 6312. The plurality of first terminal grooves 6311 and the first mounting groove 6312 are communicating with the plug space 620. The bottom wall 632 includes a plurality of second terminal grooves 6321 and a second mounting groove 6322. The plurality of second terminal grooves 6321 and the second mounting groove 6322 are communicating with the plug space 620. Each of the left wall 633 and the right wall 634 includes a side slot 635. The side slots 635 are communicating with the plug space 620. The first plug insulator 63 and the second plug insulator 64 are formed in a stepped shape. The second plug insulator 64 includes a plurality of protruding portions 641.

The two rows of plug terminals 7 include upper plug terminals 74 and lower plug terminals 75. Each of the plug terminals 7 includes a securing portion 71, an engaging portion 72 extending from one end of the securing portion 71, and a soldering portion 73 extending from the other end of the securing portion 71.

The latch 81 is made of metal material. The latch 81 includes a main portion 811, a pair of locking arms 812 on both sides of the main portion 811, and a soldering pin 8122 located at the rear of each locking arm 812. The head of each locking arm 812 is provided with a locking head 8121.

Each grounding member 83 includes a frame portion 831 which has a gap, a resilient region 8311 at the front end of the frame portion 831, and a pair of mounting portions 8312 on both sides of the frame portion 831.

The metal shell 90 includes an upper docking side wall 91 and a bottom docking side wall 92. The upper docking side wall 91 includes an identification protrusion extending outwardly from the upper docking side wall 91. The identification protrusion is corresponded mating with the mating protrusion of the receptacle connector 200. The identification protrusion allows the plug connector 600 to be mated normally with the receptacle connector 200 having the mating protrusion to prevent the plug connector 600 from reversely mating with the receptacle connector 200 having a mating protrusion. In addition, the identification protrusion also does not allow the plug connector 600 to be mated with a standard receptacle connector having no the mating protrusion to prevent mating in a wrong way. The identification protrusion is a second convex portion 911 on the upper docking side wall 91 and formed by stamped outwardly. The second convex portion 911 extends rearward from the front end of the metal shell 90. The metal shell 90 further includes a stepped portion 95 at the rear end thereof. The stepped portion 95 has a plurality of resisting arms 951. Each resisting arm 951 is formed by tearing in the vertical direction.

Referring to from the FIGS. 9-12, the upper plug terminals 74, the lower plug terminals 75, and the latch 81 are integrated with the second plug insulator 64 to from a rear module. The securing portion 71 of each upper plug terminal 74 and each lower plug terminal 75, the main portion 811 and a part of each locking arm 812 are retained in the second plug insulator 64. The plug connector 600 is installed on a printed circuit board (not shown). One of the soldering pins 8122 is located above the main portion 811 while the other one is located under the main portion 811 making the soldering pins 8122 clap the printed circuit board along the vertical direction.

The rear module retained with the upper plug terminals 74, the lower plug terminals 75, and the latch 81 is inserted from the rear end of the first plug insulator 63. The engaging portion 72 of each upper plug terminal 74 is inserted into the corresponding each first terminal groove 6311 and protrudes into the plug space 620. The engaging portion 72 of each lower plug terminal 75 is inserted into the corresponding each second terminal groove 6321 and protrudes into the plug space 620. Each locking arm 812 is inserted into the side slot 635 and the locking head 8121 of the locking arm 812 protrudes into the plug space 620.

One of the second insulative plates 82 is installed in the first mounting groove 6312 while the other one is installed in the second mounting groove 6322. One of the grounding members 83 is installed in the first mounting groove 6312 while the other one is installed in the second mounting groove 6322. The resilient region 8311 protrudes into the plug space 620. The mounting portion 8312 of each grounding member 83 is retained in the first plug insulator 63. The second insulative plate 82 is located between the engaging portions 72 of the plug terminals 7 and the grounding member 82 to prevent the plug terminals 7 mating with the grounding member 82 in a wrong way.

The metal shell 90 is assembled to the outside of the first plug insulator 63 and the second plug insulator 64. The second plug insulator 64 resists forwardly against the stepped portion 95 of the metal shell 90. Each resisting arm 951 resists forwardly against the rear end of each protruding portion 641 of the second plug insulator 64 preventing the first plug insulator 63 and the second plug insulator 64 moving rearward.

Referring to the FIGS. 1-2 and 13-14, during use of the electrical connector assembly 100, the upper terminals 44 of the receptacle connector 200 transmit a first set of signals, the lower terminals 45 of the receptacle connector 200 transmit a second set of signals.

First of all, the second convex portion 911 of the plug connector 600 is aligned with the first convex portion 551 of the receptacle connector 200. Then, the plug connector 600 is inserted within the mating cavity 540 of the receptacle connector 200. The first convex portion 551 and the second convex portion 911 are sliding fit; on the contrary, the second convex portion 911 abuts against the front end of the bottom side wall 56 so that the plug connector 600 can not be inserted into the mating cavity 540 of the receptacle connector 200. At this time, the two rows of plug terminals 7 of the plug connector 600 are mated normally with the two rows of terminals 4 of the receptacle connector 200. The pair of locking heads 8121 sandwich the pair of concave grooves 331 of the tongue portion 33 and contact with the pair of metallic shielding plates 51, thereby functioning as a fixed and grounded connection with the receptacle connector 200. The resilient region 8311 sandwiches the rear end of the tongue portion 33. The pair of second elastic arms 561 are abutted against the outer surface of the metal shell 90, thereby functioning as a fixed and grounded connection with the plug connector 600.

In the preferred embodiment, the receptacle connector 200 is installed on an electronic device (not shown) capable of controlling the function of changing the lower terminals 45 of the receptacle connector 200 to transmit different signals. The plug connector 600 provided with the second convex portion 911 can be only mated normally with the receptacle connector 200 provided with the first convex portion 551. The upper plug terminals 74 are mated normally with the upper terminals 44 to transmit the first set of signals. The lower plug terminals 75 are mated normally with the lower terminals 45 to transmit the second set of signals. Only one set of signals conforming to USB 2.0, USB 3.0 or USB 3.1 can be transmitted between the receptacle connector 200 and the plug connector 600, and another set of additional signals developed according to a specific demand can be transmitted at the same time. For example, the electronic device can control the first set of signals is one set of signals conforming to USB 2.0, USB 3.0 or USB 3.1, the second set of signals is one set of additional signals. In addition, the receptacle connector 200 provided with the first convex portion 551 also allows a standard plug connector (not shown) to be mated normally or reversely with it, the electronic device can control the first set of signals and the second set of signals transmitted between the receptacle connector 200 and the standard plug connector to conform to USB 2.0, USB 3.0 or USB 3.1. The receptacle connector 200 of the preferred embodiment has a higher compatibility function to be inserted with more than one plug connector 600.

In another embodiment, the mating protrusion of the receptacle connector is a first tab. The first tab is formed by bending outwardly from the front end of the upper side wall by tearing. A stripe-shaped first cutout is formed on one side of the first tab and on the front end of the upper side wall. The first cutout communicates with the front end edge of the shielding shell. The identification protrusion of the plug connector is a second tab. The second tab is formed by bending outwardly from the front end of the upper docking side wall by tearing. When the plug connector is inserted into the receptacle connector, the second tab is inserted into the first cutout. The receptacle connector provided with the mating protrusion of such embodiment allows the plug connector provided with the identification protrusion to be only mated normally with it. The receptacle connector provided with the mating protrusion of such embodiment also allows a standard plug connector to be mated normally or reversely with it.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. A receptacle connector for mating with a plug connector, the receptacle connector comprising:

a terminal module comprising an insulative housing, two rows of terminals, and a metallic shielding plate, the insulative housing having a base portion and a tongue portion extending forwardly from the base portion in a front-to-rear direction, the tongue portion defining two opposite surfaces, the two rows of terminals being reversely-symmetrically arranged at the two surfaces of the tongue portion, the metallic shielding plate located between the two rows of terminals; and a shielding shell retained to the insulative housing and forming a mating cavity to receive the tongue portion, the shielding shell having a plurality of side walls;

wherein the shielding shell defines a mating protrusion on one of the plurality of side walls, the mating protrusion extending outwardly to be precluded from reversely mating with the plug connector which has a contour compliant with said mating cavity and an identification protrusion accommodated in the mating protrusion; said two rows of terminals transmit different first and second sets of signals, respectively, when the plug connector having the identification protrusion is mating normally with the receptacle connector, and when the plug connector having two rows of plug terminals positioned to have 180 degree symmetry but no identification protrusion is normally or reversely mating with the receptacle connector, the two rows of terminals transmit the same first and second sets of signals, respectively.

2. The receptacle connector as claimed in claim 1, wherein said mating protrusion is a first convex portion on the one side wall, the first convex portion extending rearward from a front end edge of the shielding shell, and a front end edge of the first convex portion is flush with the front end edge of the shielding shell.

3. The receptacle connector as claimed in claim 1, wherein said plurality of side walls of the shielding shell include an upper side wall and a bottom side wall opposite to the upper side wall, said mating protrusion is located on said upper side wall, said mating protrusion is formed by outward punching or tearing, said bottom side wall comprises a plurality of elastic arms for attaching the plug connector and a plurality of front stopping portions for resisting rearward the base.

4. An electrical receptacle connector adapted to mate with either a first type plug connector or a second type plug connector wherein the first type plug connector is equipped with an outwardly extending identification protrusion while the second type plug connector is not equipped with said outwardly extending identification protrusion, said receptacle connector comprising:

a terminal module comprising an insulative housing, two rows of terminals, and a metallic shielding plate, the insulative housing having a base portion and a tongue portion extending forwardly from the base portion in a front-to-rear direction, the tongue portion defining two opposite surfaces, the two rows of terminals being reversely-symmetrically arranged at the two surfaces of the tongue portion, the metallic shielding plate located between the two rows of terminals; and a shielding shell retained to the insulative housing and forming a mating cavity to receive the tongue portion, the shielding shell having a plurality of side walls and further on one of the plurality of side walls an outwardly extending mating protrusion; wherein the receptacle connector is adapted to receive the first type plug connector in the mating cavity in a single orientation where the identification protrusion is accommodated in the outwardly extending mating protrusion or to receive the second type plug connector in the mating cavity in dual orientations where no identification protrusion is accommodated in the outwardly extending mating protrusion; wherein said mating plug connector comprising: an insulative body having a plug space; two rows of plug terminals arranged at opposite upper wall and bottom wall of the plug space; a latch having a pair of locking heads extending into two opposite lateral sides of plug space; and a metal shell retained to the insulative body and having a plurality of docking side walls; wherein the metal shell defines on one of the plurality of docking side walls an identification protrusion extending outwardly; the mating protrusion is adapted to mate with the identification protrusion; and the mating protrusion cooperates with the identification protrusion to allow the plug connector to be mated normally with the receptacle connector and to connect the two rows of terminals respectively normally with the two rows of plug terminals.

5. A plug connector for mating with a receptacle connector having an outwardly extending mating protrusion on a metallic shield thereof, the plug connector comprising:

an insulative body having a plug space;

two rows of plug terminals arranged at opposite upper wall and bottom wall of the plug space;

a latch having a pair of locking heads extending into two opposite lateral sides of the plug space; and a metal shell retained to the insulative body and having a plurality of docking side walls;

wherein the metal shell defines an outwardly extending identification protrusion on one of the plurality of docking side walls, to allow the plug connector to be received normally within said receptacle connector in a single orientation when said outwardly extending identification protrusion is accommodated in the outwardly extending mating protrusion while said plug connector is adapted to be received within said receptacle connector in dual orientations by removing the outwardly extending identification protrusion thereform.

6. The plug connector as claimed in claim 5, wherein said plurality of docking side walls of the metal shell include an upper docking side wall and a bottom docking side wall opposite to the upper docking side wall, and said identification protrusion is a second convex portion located on said upper docking side wall, the second convex portion extending rearward from a front end of the metal shell.

7. The plug connector as claimed in claim 5, wherein said two rows of plug terminals are to transmit two different sets of signals.

8. The electrical receptacle connector as claimed in claim 4, wherein said two rows of terminals transmit different first and second sets of signals, respectively, when the receptacle connector is mated with the first type plug connector in said single orientation.

9. The electrical connector assembly as claimed in claim 4, wherein said two rows of terminals are to transmit similar first and second sets of signals, respectively, when the receptacle connector is mated with the second type plug connector in said dual orientations.

* * * * *